US005157757A

United States Patent [19]

McDougall

[11] Patent Number: 5,157,757

[45] Date of Patent: Oct. 20, 1992

[54] HAND HELD HAIR DRYER WITH SELECTIVELY POSITIONABLE BAFFLE FOR VARYING THE DISTRIBUTION OF AIR FROM THE DRYER

[75] Inventor: John G. McDougall, Kowloon, Hong Kong

[73] Assignee: China Pacific Trade Ltd., British Virgin Isls.

[21] Appl. No.: 699,633

[22] Filed: May 14, 1991

[51] Int. Cl.[5] ..... A45D 20/12; F24H 3/04; H05B 3/00

[52] U.S. Cl. ..... 392/383; 34/97; 34/243 R; 239/455; 392/365; 392/367; 392/385

[58] Field of Search ..... 392/379-385, 392/360-369; 34/96-101, 243 R; 239/443, 455

[56] References Cited

U.S. PATENT DOCUMENTS

| | | | |
|---|---|---|---|
| 43,484 | 7/1864 | Dykeman et al. | 239/455 |
| 2,603,062 | 7/1952 | Weiler et al. | 239/455 |
| 3,797,752 | 3/1974 | Cercone | 392/385 |
| 4,232,454 | 11/1980 | Springer | 239/455 X |
| 4,602,146 | 7/1986 | Barns et al. | 392/379 |

FOREIGN PATENT DOCUMENTS

| | | | |
|---|---|---|---|
| 568043 | 1/1933 | Fed. Rep. of Germany | 34/243 R |

*Primary Examiner*—Anthony Bartis

*Attorney, Agent, or Firm*—Burns, Doane, Swecker & Mathis

[57] ABSTRACT

A handheld electrically powered hair dryer includes a main outlet nozzle and secondary air outlets for producing a diffuse distribution of air. A baffle arrangement is moveable between first and second positions to selectively deflect some or all of the air from the nozzle to the secondary air outlets. The baffle arrangement consists of a flexible crown-shaped metal foil disposed on the inside of the nozzle, and a mechanism for bending the foil radially inwardly to partially or completely block the nozzle when the baffle is moved toward the second position.

2 Claims, 4 Drawing Sheets

HAND HELD HAIR DRYER WITH SELECTIVELY POSITIONABLE BAFFLE FOR VARYING THE DISTRIBUTION OF AIR FROM THE DRYER

FIELD OF THE INVENTION

The present invention relates to variable airflow handheld hair dryers of the type which comprise a nozzle for directing a flow of warm air towards hair to be dried, styled and set.

PRIOR ART

Variable airflow handheld hair dryers of the type described have previously been proposed. U.S. Pat. No. 4,097,722 to Soler proposes a handheld hair dryer including a selectively adjustable air deflecting damper provided in the barrel for adjusting the area of the nozzle. The damper may be operated to constrict the area of the nozzle, thereby producing a more concentrated airflow. U.S. Pat. No. 4,232,454 to Springer discloses a similar arrangement, with a pair of trap doors located in the barrel.

The above proposals both relate to variable airflow handheld hair dryers which allow the flow of air to be further concentrated. However, in many cases it is desirable to reduce the concentration of the airflow, because a very concentrated stream of air may disturb the arrangement of the hair which is being dried, styled or set.

My earlier U.S. patent application No. 07/674,900 describes and claims a handheld hair dryer comprising a nozzle for directing warm air towards the hair, secondary air outlets adjacent the nozzle for producing a more diffuse distribution of air, and a baffle arrangement which may be set so as to allow substantially all of the air to flow through the nozzle, or may be set so as to deflect substantially all of the air through the secondary air outlets. The preferred construction of baffle arrangement comprises an umbrella-like structure, centrally located in the nozzle. The umbrella-like structure may be opened out to block the nozzle. The umbrella-like structure may be collapsed so as to allow air to flow through the nozzle. The umbrella-like structure may also be set to intermediate positions. This arrangement overcomes the disadvantages of the Soler and Springer proposals. In particular this arrangement allows the flow of air to be diffused over a wider area in a controlled and adjustable manner, and allows the flow of air through the nozzle to be reduced or eliminated altogether so that there is no concentrated stream or jet of air disturbing hair which is being set. My earlier U.S. patent application No. 07/674,900, now abandoned also describes and claims an attachment for an existing hair dryer, the attachment having the features and advantages described above.

However, the arrangement described in my earlier abandoned U.S. patent application No. 07/674,900 has certain disadvantages. When the umbrella-like structure is collapsed it nevertheless occupies a certain volume in the centre of nozzle, rather than leaving the nozzle completely unobstructed. Secondly, while the umbrella-like structure may be readily adjusted to the fully collapsed or fully erected state, it is difficult to finely adjust to intermediate settings between the fully collapsed and fully erected state. Thirdly, the fully erected umbrella does not provide a streamlined deflection of air to the secondary air outlets.

SUMMARY OF THE INVENTION

An object of the present invention is to provide a hair dryer of the type described with an improved air flow arrangement.

The invention provides a handheld hair dryer comprising a nozzle for directing warm air towards the hair, secondary air outlets adjacent the nozzle for producing a more diffuse distribution of air, and a baffle arrangement which may be set so as to allow substantially all of the air to flow through the nozzle, or may be set so as to deflect substantially all of the air through the secondary air outlets, wherein the baffle arrangement comprises a baffle element movable between a first position in which the baffle element is disposed circumferentially about the inside wall of the nozzle so as to leave a substantially unobstructed passage for air flow through the nozzle, and a second position in which the baffle element is moved radially inwardly to close off the nozzle.

In a preferred construction the baffle arrangement comprises a crown shaped flexible metal foil disposed about the inside wall of the nozzle, a guide element located within the nozzle for guiding the apices of the crown towards the centre of the nozzle, and a mechanism for causing relative axial movement of the metal foil and the guide element so that the crown may be moved towards the guide and the apices move radially inwardly to close off the nozzle.

Figure 1:
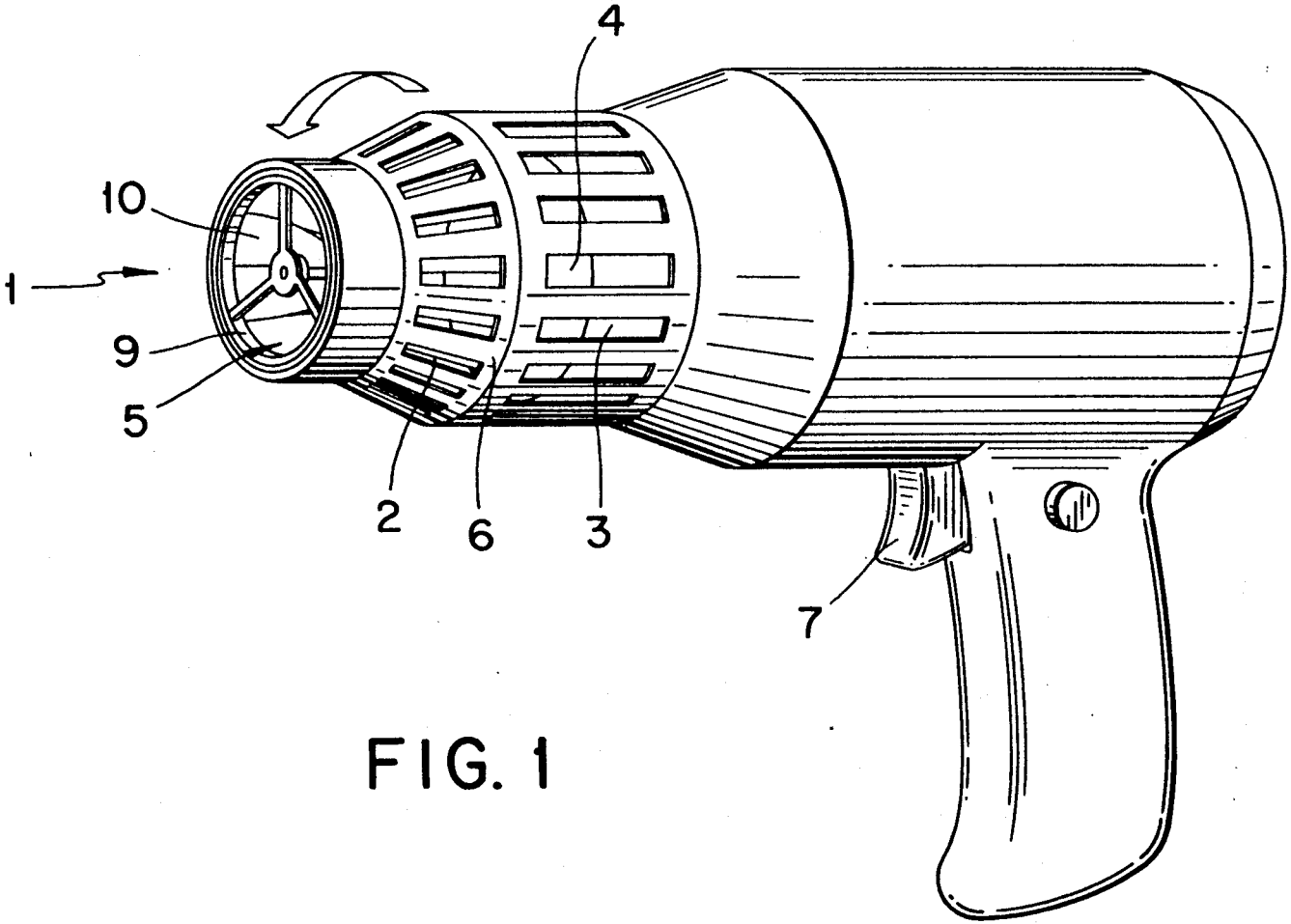
FIG. 1 is a perspective view of a hair dryer according to the invention.
Figure 2:
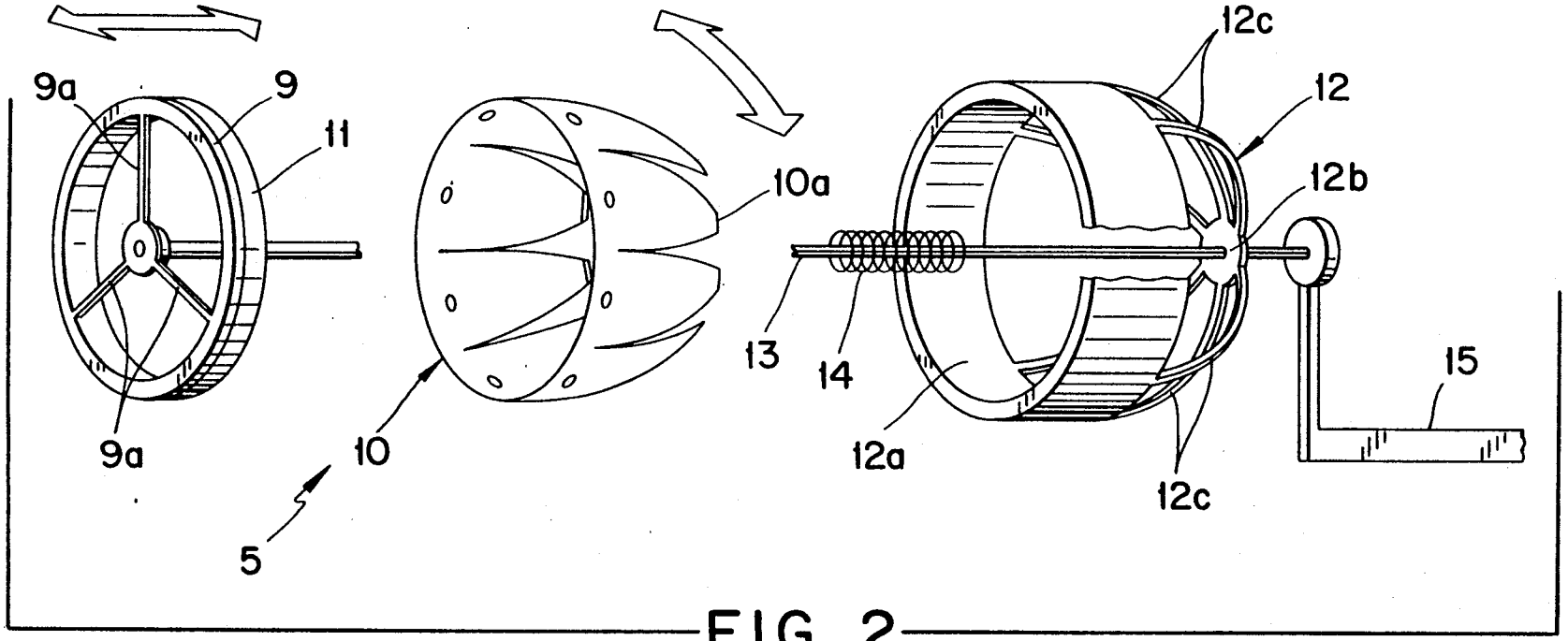
FIG. 2 is an exploded perspective view on a larger scale illustrating the baffle arrangement.

Referring to the drawings and in particular to FIG. 1, the hair dryer is of the conventional "pistol type"arrangement. The barrel includes three different types of air outlets, namely an air nozzle 1, secondary air outlets 2, and air vents 3. The barrel includes an internal conical collar 4 for directing air to the nozzle 1. The barrel includes a baffle arrangement generally designated 5 (see FIG. 2), which may be operated to deflect air from the nozzle 1 to the secondary air outlets 2. The hair dryer also includes a rotatable collar 6 which is rotatable to close-off or to open the secondary air outlets 2. The baffle arrangement 5 may be adjusted to intermediate settings so that some of the air flows through the nozzle 1 while some is deflected to the secondary air outlets 2. The rotatable collar 6 may be rotated to intermediate settings between a position in which the secondary air outlets 2 are fully covered and a position in which the secondary air outlets are fully open.

The airflow and the adjustment thereof will now be described in more detail. Air passing through the nozzle 1 produces a concentrated drying effect over a small area. Air passing through the secondary air outlets 2 produces a moderate drying effect over a wider area. Air emerging through the air vents 3 is directed away from the hair, and the primary purpose of these vents is to prevent any air back-pressure which might cause overheating of the electrical heating element of the hair dryer.

With three different possible outlets 1, 2, 3 for the air, and with a baffle arrangement 5 and a rotatable collar 6 each of which may be varied over a range of settings, a wide variety of different patterns of airflow can be produced. A number of these different airflow patterns will now be described.

The hair dryer may be operated in the same way as a conventional hair dryer, that is to say with a stream of warm air coming through the nozzle 1. This airflow pattern is achieved by not bringing the baffle arrangement 5 into operation, so that air may flow freely through the nozzle 1.

The hair dryer may be used to produce a more diffuse pattern than is possible with a conventional hair dryer, so as to assist in styling and setting. The diffuse pattern of airflow is produced by rotating the collar 6 so that the secondary air outlets 2 are open, and by operating the baffle arrangement 5 so that all the air is deflected back from the nozzle 1 to the secondary outlets 2.

The hair dryer may be operated in similar manner to a conventional hair dryer, but with a much reduced airflow. This reduced airflow pattern is achieved by rotating the collar 6 to partially close the secondary air outlets 2, and by partially operating the baffle arrangement 5 so that some of the air reaching the nozzle 1 passes out through the nozzle, but some of the air is deflected back to the secondary air outlets 2.

It will be appreciated that a variety of other air patterns may be produced. The manner of adjusting the air flow pattern will now be described. The baffle arrangement 5 is operated by means of a finger trigger 7 on the handle of the hair dryer which is connected by means of a linkage 15 to the baffle arrangement 5. A locking mechanism (not shown) is provided for locking the baffle arrangement 5 in a particular state. The collar 6 is rotated manually.

The construction of the baffle arrangement 5 will now be described. The baffle arrangement 5 comprises essentially an annular holder 9, which is located within the nozzle 1 and moveable linearly along the nozzle, a crown shaped flexible metal foil 10 which is mounted on the holder 9, a locking ring 11 for holding the metal foil in position, and an open frame guide element 12 which is fixed within the nozzle 1, a shaft 13 which is connected to spokes **9*a* on the moveable holder for pulling the moveable holder 9 and crown shaped metal foil 10 towards the guide element 12, and a coil spring 14 for biassing the holder 9 and the metal foil 10 away from the guide element 12. The open frame guide element 12 is generally cup-shaped and comprises an annular rim 12*a* that is fixed to the nozzle, a central hub 12*b* at the base of the cup, and a plurality of spaced curved ribs 12*c* that extend from the rim 12*a* to the hub 12*b*. The shaft 13 slidably extends through a central hole in the hub 12*b***.

Figure 6:
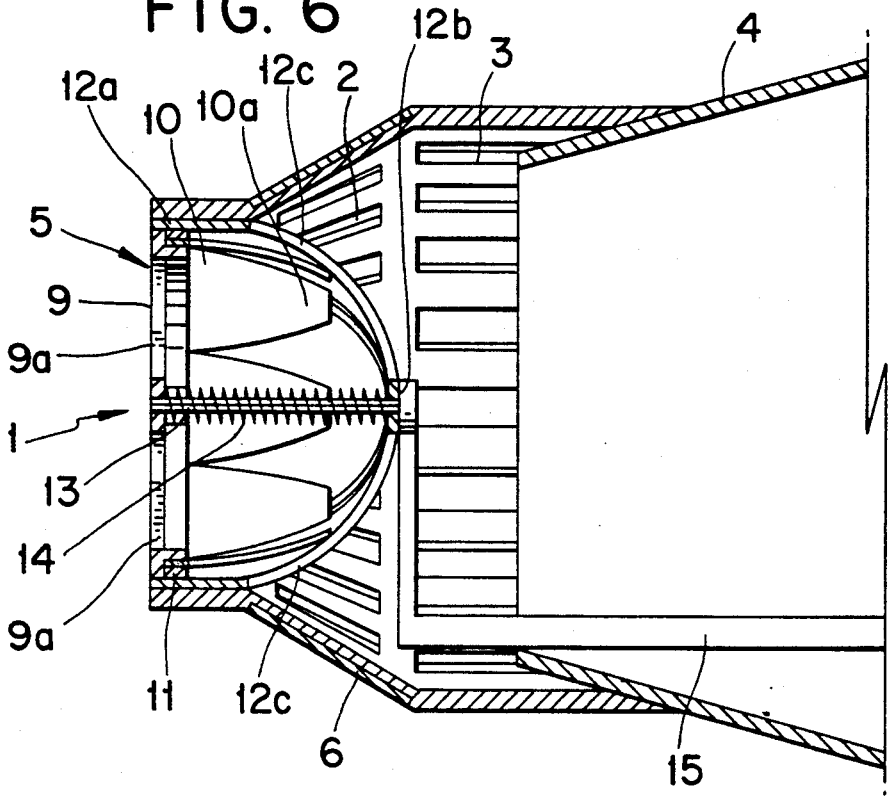
FIG. 6 is a cross-sectional side view of the nozzle with the baffle in an open position.
Figure 7:
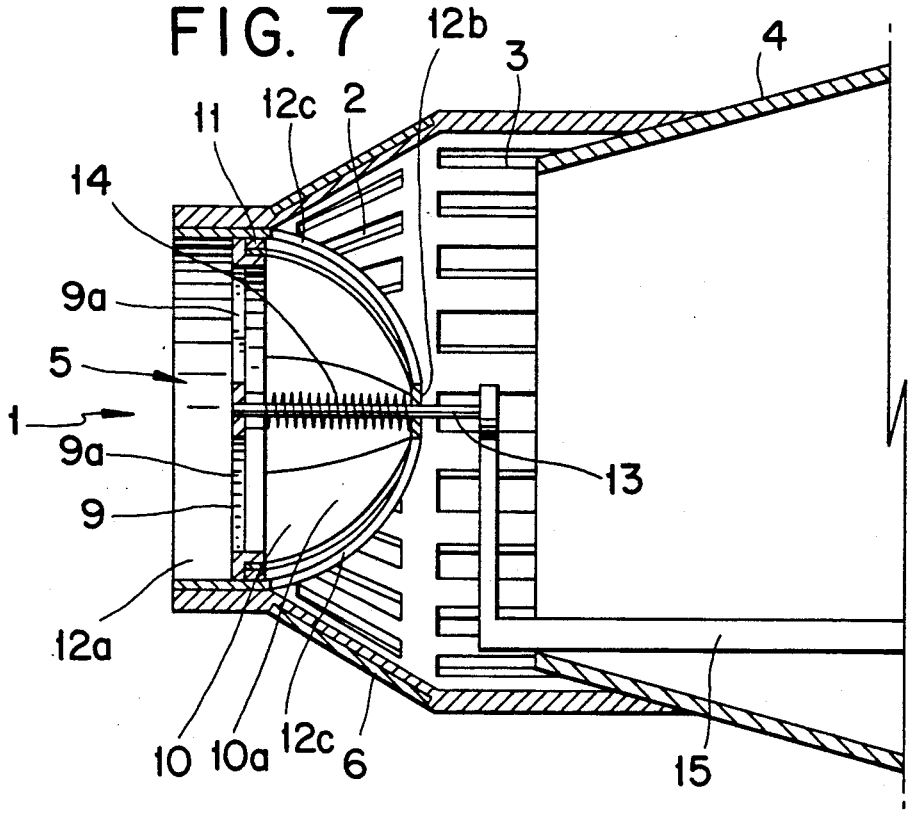
FIG. 7 is a cross-sectional side view of the nozzle with a the baffle in a closed position.

If the finger trigger 7 is not operated, the metal foil 10 remains in the state shown in FIG. 6, allowing air to pass freely along the nozzle 1. However, if the finger trigger 7 is operated the moveable holder 9 and metal foil 10 move linearly towards the fixed guide element 12 against the bias of the spring 14 to cause the apices **10*a* of the crown shaped metal foil to engage the curved ribs 12*c* of the guide element 12, which causes the flexible foil apices 10*a* to curve inwardly, gradually closing off the nozzle. When the finger trigger 7 is fully retracted the segments of the crown shaped metal foil overlap one another to completely block the nozzle 1 as shown in FIG. 7**.

The internal conical collar 4 assists in producing a streamlined flow of air. Firstly, the inner surface of the internal conical collar 4 serves to direct air from the hair dryer to the nozzle 1, and in particular ensures that the air flows in a streamlined flow to the centre of the nozzle 1 and does not escape through the air vents 3. Secondly, when the baffle arrangement 5 is operated so that air is deflected back from the nozzle 1, the outer surface of the conical collar 4 then serves to direct the air to the air vents 3, and in particular the collar is shaped and dimensioned to ensure a streamlined flow of air back to the vents 3, without any interference between the flow of air to the baffle 5 and the flow of air back from the baffle arrangement 5 which might cause air turbulence and overheating.

Figure 3:
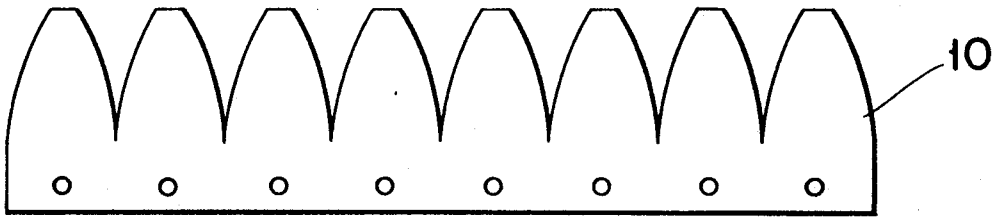
FIGS. 3, 4 and 5 are views of individual components of the baffle arrangement.
Figure 5:
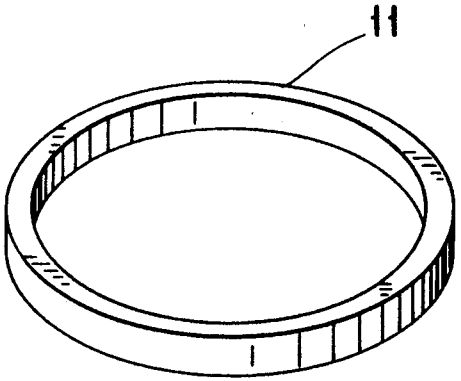
Figure 4:
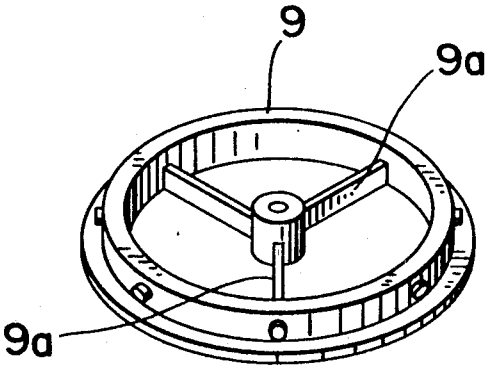

FIG 3 is a side view of the metal foil 10, FIG. 4 is a perspective view of the holder 9, and FIG. 5 is perspective view of the locking ring 11.

It will be appreciated that the baffle arrangement 5 described above possesses certain advantages over that described in my earlier U.S. patent Application No. 07/674,900. In particular, when the baffle arrangement is not operated, the metal foil is disposed against the sidewall of the nozzle, allowing substantially unobstructed flow of air through the nozzle. Furthermore, the adjustment of the baffle arrangement 5 to intermediate settings can be controlled much more accurately. Finally, when the baffle arrangement 5 is operated, a more streamlined deflection of air is achieved.

I claim:

1. A hand held hair dryer comprising a nozzle for directing warm air towards the hair, air outlets in a wall of the hair dryer upstream of the nozzle, and a baffle arrangement which may be selectively set to allow substantially all of the air to flow through the nozzle or to deflect substantially all of the air away from the nozzle and out through the air outlets, the baffle arrangement comprising a flexible metal foil having the shape of a segmented crown, each segment having a flexible apex with the apices being directed in an axial direction and the crown being disposed circumferentially outwardly about the inside wall of the nozzle so as to leave a substantially unobstructed central passage through the crown for air flow through the nozzle, a guide element located with the nozzle in axial alignment with the segmented crown and shaped to deflect the apices of the crown towards the center of the nozzle, and a mechanism for selectively causing relative axial movement of the metal foil baffle element and the guide element so that the crown may be moved towards the guide element and the apices deflected by the guide element radially inwardly into an overlapping relationship to close off the central passage through the baffle arrangement and deflect the air towards the air outlets.

2. A hand held hair dryer in accordance with claim 1 wherein the air outlets comprise secondary air outlets for producing a diffuse distribution of air flowing to the hair and air vents for directing air away from the hair and wherein a further baffle arrangement is provided for the secondary air outlets, said further baffle arrangement comprising a baffle element movable between a first position in which the baffle element leaves a substantially unobstructed passage for air flow through the secondary air outlets, and a second position in which the baffle element substantially closes off the secondary air outlets.

* * * * *